United States Patent [19]

Kelly

[11] 4,114,346

[45] Sep. 19, 1978

[54] METHOD AND PRODUCT FOR INSTALLATION OF SHEET FLOORING

[75] Inventor: Edward G. Kelly, Allentown, Pa.

[73] Assignee: GAF Corporation, New York, N.Y.

[21] Appl. No.: 837,391

[22] Filed: Sep. 28, 1977

[51] Int. Cl.[2] ..... E04F 13/20

[52] U.S. Cl. ..... 52/746; 33/17 R; 156/71; 428/40

[58] Field of Search ..... 52/746; 156/71; 428/40; 33/12, 17 R

[56] References Cited

U.S. PATENT DOCUMENTS

| | | | |
|---|---|---|---|
| 2,411,328 | 11/1946 | MacNab | 33/17 R |
| 3,408,250 | 10/1968 | Finefrock | 52/746 X |
| 3,639,500 | 2/1972 | Muny et al. | 428/40 X |
| 4,024,837 | 5/1977 | Snyder | 428/40 X |

FOREIGN PATENT DOCUMENTS

| | | | |
|---|---|---|---|
| 1,416,684 | 12/1975 | United Kingdom | 52/746 |

*Primary Examiner*—Alfred C. Perham
*Attorney, Agent, or Firm*—Walter C. Kehm; J. G. Mohr

[57] ABSTRACT

The pattern of a room to be covered by a sheet vinyl or other sheet material is determined by using a roll of paper, which has pressure sensitive adhesive bands on both sides, each covered with a release paper. The paper is placed around the periphery of the room with a portion of the paper projecting up the wall. The paper is then affixed to the floor by removing the release paper from the adhesive on the underside of the paper, pressed into the intersections of the wall and floor and cut with a knife to conform to the periphery dimensions of the floor thereby creating a floor dimension pattern or template. The sheet vinyl or other sheet flooring material is then placed over the paper pattern or template in such a manner that it projects slightly up the wall. After it is laid out in this manner, the release paper is removed from the adhesive on the upper side of the paper pattern or template by picking up the sheet flooring from the paper pattern or template and pulling off the release strip. When the sheet flooring is placed down again, it bonds to the paper pattern or template. The adhesive strength of the top band of the paper pattern or template is greater than the under side adhesive band and therefore when the sheet flooring is picked up for trimming, the paper pattern or template releases from the floor and remains attached to the sheet flooring at the exact position it should be with respect to all points in the room. The sheet flooring is then cut at the outer edges of the paper pattern or template to obtain the exact dimensions of the room. The sheet flooring can then be placed down for final laying.

1 Claim, 4 Drawing Figures

METHOD AND PRODUCT FOR INSTALLATION OF SHEET FLOORING

BACKGROUND OF THE INVENTION

In the past, installations of large sheet flooring material has caused difficulties, especially to the do-it-yourself installer. In order to obtain a perfect fit of the floor covering, in relationship to the walls, doors and other openings that span the periphery of the floor, one in the past had to take exact measurements or else try to place the flooring material in the room, in such a manner so that he was able to line-up the flooring with the type of cut that had to be made to properly fit the floor. Both of the above methods do not assure an exact fit and cause quite a headache to the do-it-yourself installer.

It is therefore an object of the present invention to provide an uncomplicated easy method and product for obtaining an exact floor edge template to assist the installer in cutting the flooring material so that it is an exact match to the floor dimensions.

SUMMARY OF THE INVENTION

A simple, but exact template is obtained to assist one in covering a floor with a sheet flooring material by lining the outer edges of the floor with a flexible sheet material, such as paper, having adhesive bands covered by release paper on both the upper and lower faces of said flexible sheet. The release paper, covering the adhesive band, that is to come into contact with the floor, is removed just prior to placing the flexible sheet on the floor. A portion of the flexible sheet, when the sheet is placed upon the floor overlays the floor and covers a portion of the walls adjacent to said floor. The overlay of the sheet is then cut along the periphery of the outer dimensions of the room to match exactly the outer dimensions of the floor. After cutting, the installer places upon the floor and over the flexible sheet, the floor covering, that is to be installed in the room. He then picks up a portion of the flooring and removes the release paper from the top face of the flexible sheet that is beneath this portion of flooring and relays the flooring upon the now exposed adhesive band. This process is continued until all the release paper is removed and the flooring is affixed to the adhesive band on the top face of the flexible sheet. Since the adhesive of the adhesive band, on the top face of the flexible sheet, is of greater adhering strength than the adhesive on the lower face of the flexible sheet, upon picking up of the sheet flooring material the flexible sheet will adhere to the sheet flooring material as opposed to the floor. The outer edges of the flexible sheet now may be used as a template which the installer uses as a guide to trim the sheet flooring to obtain the exact floor dimensions. Once the flooring is completely cut, adhesive is placed on the floor and the flooring is laid for the final time.

DESCRIPTION OF A PREFERRED EMBODIMENT

Figure 1:
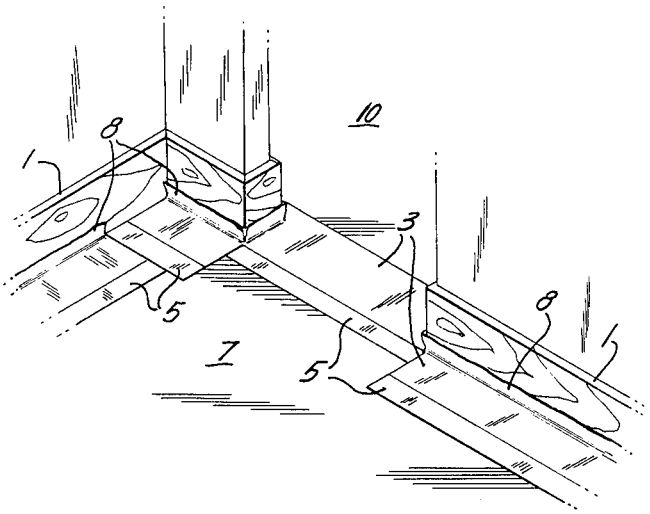
FIG. 1 is a perspective view showing the flexible sheet adhered to the floor and overlaying the wall.
Figure 2:
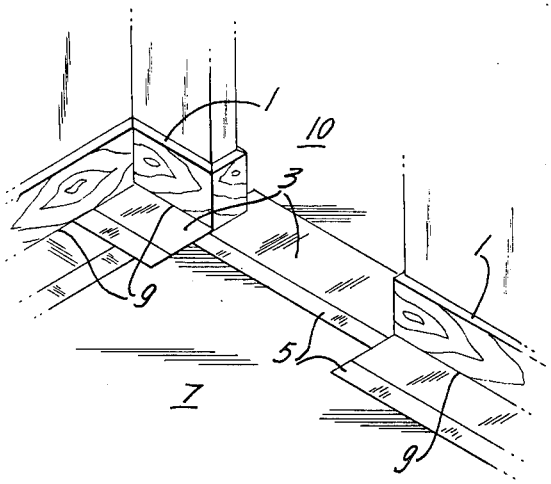
FIG. 2 is a view similar to FIG. 1, showing a flexible sheet adhering to the floor after being cut to the floor dimensions.
Figure 3:
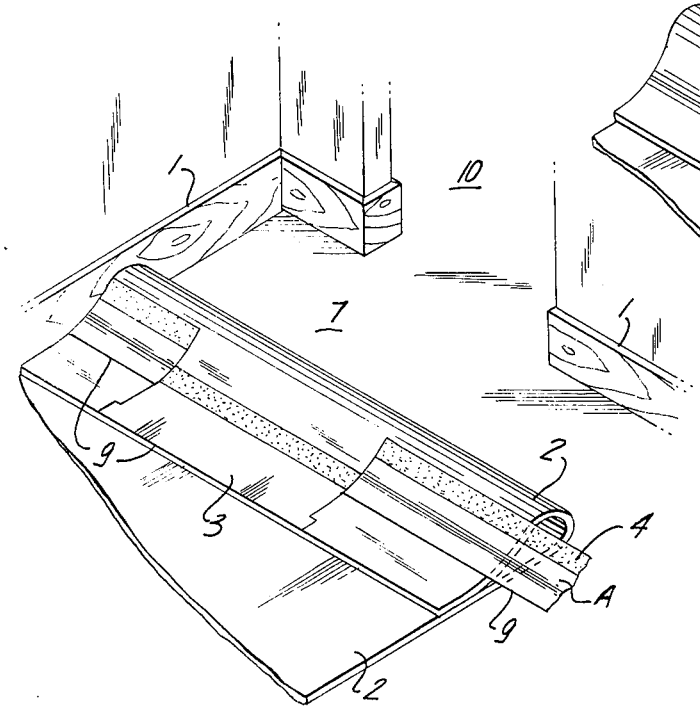
FIG. 3 is a view similar to FIG. 1, showing a flexible sheet adhering to the flooring material.
Figure 4:
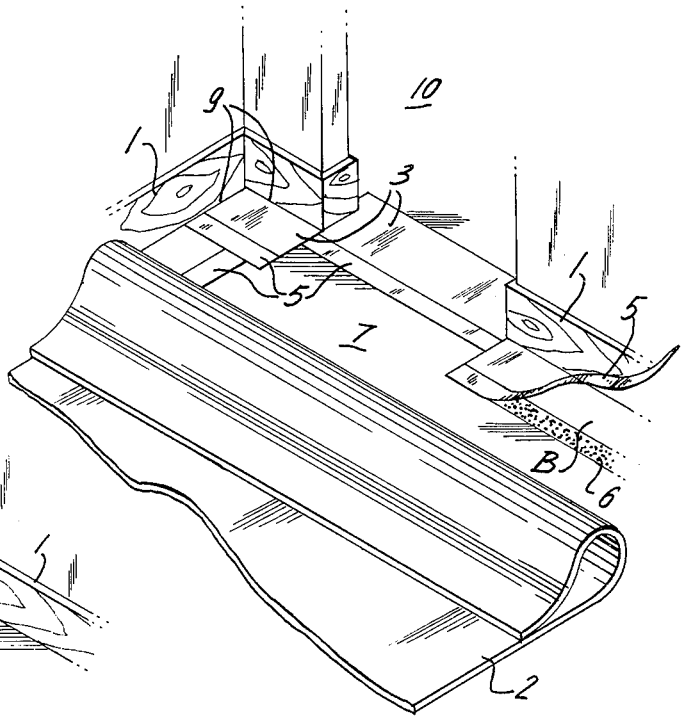
FIG. 4 is a view similar to FIG. 1, showing the removal of the top release strip from the adhesive on the top face of the flexible sheet.

A sheet flooring pattern or template is obtained by laying an easily flexed sheet material 3, in close proximity with the walls 1 of a room that is to receive sheet flooring 2. The flexed material sheet 3, such as paper, which has an adhesive band 4 on one face and an adhesive band 6 on the other face is placed upon the floor 7, adjacent to where the floor 7, and walls 1, meet. The adhesive bands 4 and 6 are covered by release strips 5. Prior to laying the flexible sheet 3, adjacent to the walls 1, the adhesive release strip 5, on side A of said flexible sheet 3, is removed leaving exposed adhesive band 4, so that when the flexible sheet 3 is laid upon the floor 7, it will adhere to the floor 7. The overlap 8, of the flexible sheet 3, is then cut, so that its cut edge 9, abutts snugly against the walls 1, and fits exactly the dimensions of any openings 10, such as doorways. After the flexible sheet 3 is cut the flooring 2 is laid in the room in such a manner, that its area is most efficiently used. Sections of flooring 2 are then picked up and the release strip 5, on face B of the flexible sheet 3, is removed leaving exposed adhesive band 6. The sheet flooring 2, is then laid upon the exposed adhesive band 6 and the procedure is repeated until all of the release paper 5, on face B, is removed and the flooring 2 is adhering to band 6. Since adhesive band 6 has stronger adhering power than adhesive band 4, when the sheet flooring 2 is picked up, flexible sheet 3 will adhere to the bottom side of flooring 2, as opposed to floor 7. The flexible strip 3, thereby forms a template on the under side of flooring 2, which the installer uses as a guide to cut along. This flexible strip 3 is then removed and adhesive is applied to the floor 7 and the flooring 2 is laid upon floor 7 for final installation.

I claim:

1. A method of installing a sheet flooring comprising the steps of:

1. affixing to a floor to be covered with a sheet flooring material, a flexible sheet that follows the periphery of a floor and overlays adjacent walls of a room,
2. cutting the flexible sheet so that its outer edges match the outer dimensions of the room,
3. laying a sheet of flooring upon the flexible sheet,
4. removing an adhesive protective strip located on the flexible sheet and exposing an adhesive strip by picking up sections of the flooring, removing the adhesive protective strip and relaying that portion of the flooring until all the adhesive protective strip is removed,
5. picking up the sheet flooring with the flexible sheet attached and cutting the flooring along the outer edges of the flexible sheet in order that the flooring is an exact match to the room,
6. relaying the flooring after removal of the flexible sheet.

* * * * *